US008419478B2

(12) United States Patent
Liu et al.

(10) Patent No.: US 8,419,478 B2
(45) Date of Patent: Apr. 16, 2013

(54) DUAL-CARD CONNECTOR

(75) Inventors: Zhu-Rui Liu, Guang-Dong (CN); Jui-Ming Chang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 27 days.

(21) Appl. No.: 13/227,448

(22) Filed: Sep. 7, 2011

(65) Prior Publication Data

US 2013/0059478 A1 Mar. 7, 2013

(51) Int. Cl.
*H01R 24/00* (2011.01)

(52) U.S. Cl.
USPC ..... 439/631; 439/159

(58) Field of Classification Search ..... 439/159, 439/630, 631; 235/492
See application file for complete search history.

(56) References Cited

U.S. PATENT DOCUMENTS

| | | | | |
|---|---|---|---|---|
| 6,468,101 | B2 * | 10/2002 | Suzuki | 439/326 |
| 6,471,550 | B2 * | 10/2002 | Maiterth et al. | 439/631 |
| 6,896,548 | B2 * | 5/2005 | Scuteri et al. | 439/541.5 |
| 7,029,306 | B2 * | 4/2006 | Bilcauu et al. | 439/326 |
| 7,726,991 | B2 * | 6/2010 | Ma et al. | 439/188 |
| 7,946,876 | B1 * | 5/2011 | Huang | 439/329 |
| 8,147,262 | B1 * | 4/2012 | Su et al. | 439/159 |

* cited by examiner

*Primary Examiner* — Thanh Tam Le
(74) *Attorney, Agent, or Firm* — Cheng-Ju Chiang

(57) ABSTRACT

A dual-card connector for receiving dual SIM (Subscriber Identification Module) cards therein includes an insulating housing, a plurality of conductive terminals, an upper cover and a lower cover. The insulating housing has a base body. A top and a bottom of the base body define two sets of longitudinal terminal grooves. Each set of the terminal grooves is divided into a front row and a rear row penetrating a front end and a rear end of the base body, respectively. The conductive terminals are received in the corresponding terminal grooves of the insulating housing for electrically connecting with the respective SIM cards. The upper cover is covered to the insulating housing to form a first insertion space therebetween for receiving a first SIM card. The lower cover is covered to the insulating housing to form a second insertion space therebetween for receiving a second SIM card.

6 Claims, 3 Drawing Sheets

DUAL-CARD CONNECTOR

BACKGROUND OF THE INVENTION

1. Field of the Invention

The present invention generally relates to a dual-card connector, and more particularly to a dual-card connector capable of improving an elaboration extent of a mobile phone.

2. The Related Art

Mobile phones have become indispensable communication tools. With a fast competence and technology development, performance of the mobile phone is developed quickly, such as dual SIM (Subscriber Identification Module) card and dual-standby function. Currently, the dual SIM card and dual-standby function is realized by a dual-card connector. The dual-card connector includes an insulating housing which defines two receiving spaces for receiving the dual SIM cards arranged along a transverse direction of the insulating housing. However, the arrangement of the receiving spaces occupies a larger space along the transverse direction of the mobile phone that is disadvantaged for the mobile phone to reach an elaboration extent.

SUMMARY OF THE INVENTION

An object of the present invention is to provide a dual-card connector adapted for receiving dual SIM cards therein includes an insulating housing, a plurality of conductive terminals, an upper cover and a lower cover. The insulating housing has a base body. A top and a bottom of the base body define two sets of longitudinal terminal grooves. Each set of the terminal grooves is divided into a front row and a rear row penetrating a front end and a rear end of the base body, respectively. The conductive terminals are received in the corresponding terminal grooves of the insulating housing for electrically connecting with the respective SIM cards. The upper cover is covered to the insulating housing. A first insertion space is formed between the upper cover and the insulating housing for receiving a first SIM card. The lower cover is covered to the insulating housing. A second insertion space is formed between the lower cover and the insulating housing for receiving a second SIM card.

As described above, the first insertion space for receiving the first SIM card and the second insertion space for receiving the second SIM card are just disposed reversely to make the dual-card connector occupied a smaller space in a mobile phone so as to improve an elaboration extent of the mobile phone and carried conveniently.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
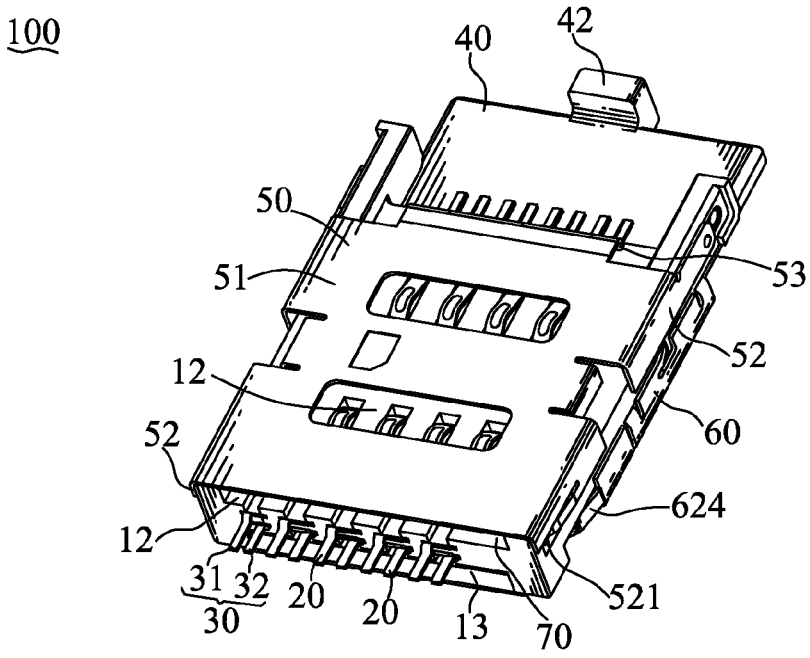
FIG. 1 is a perspective view of a dual-card connector in accordance with the present invention.
Figure 2:
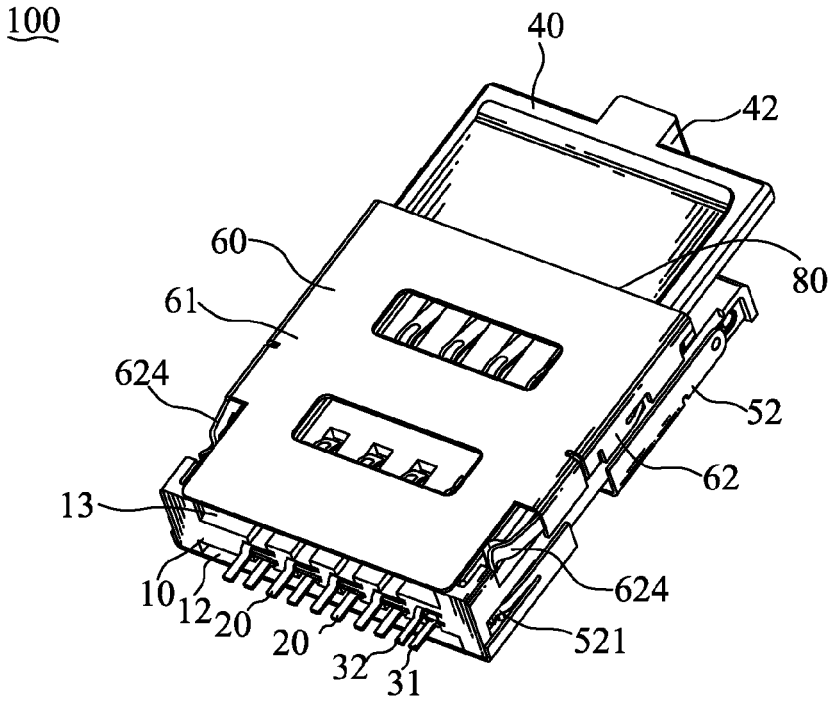
FIG. 2 is another perspective view of the dual-card connector of FIG. 1.
Figure 3:
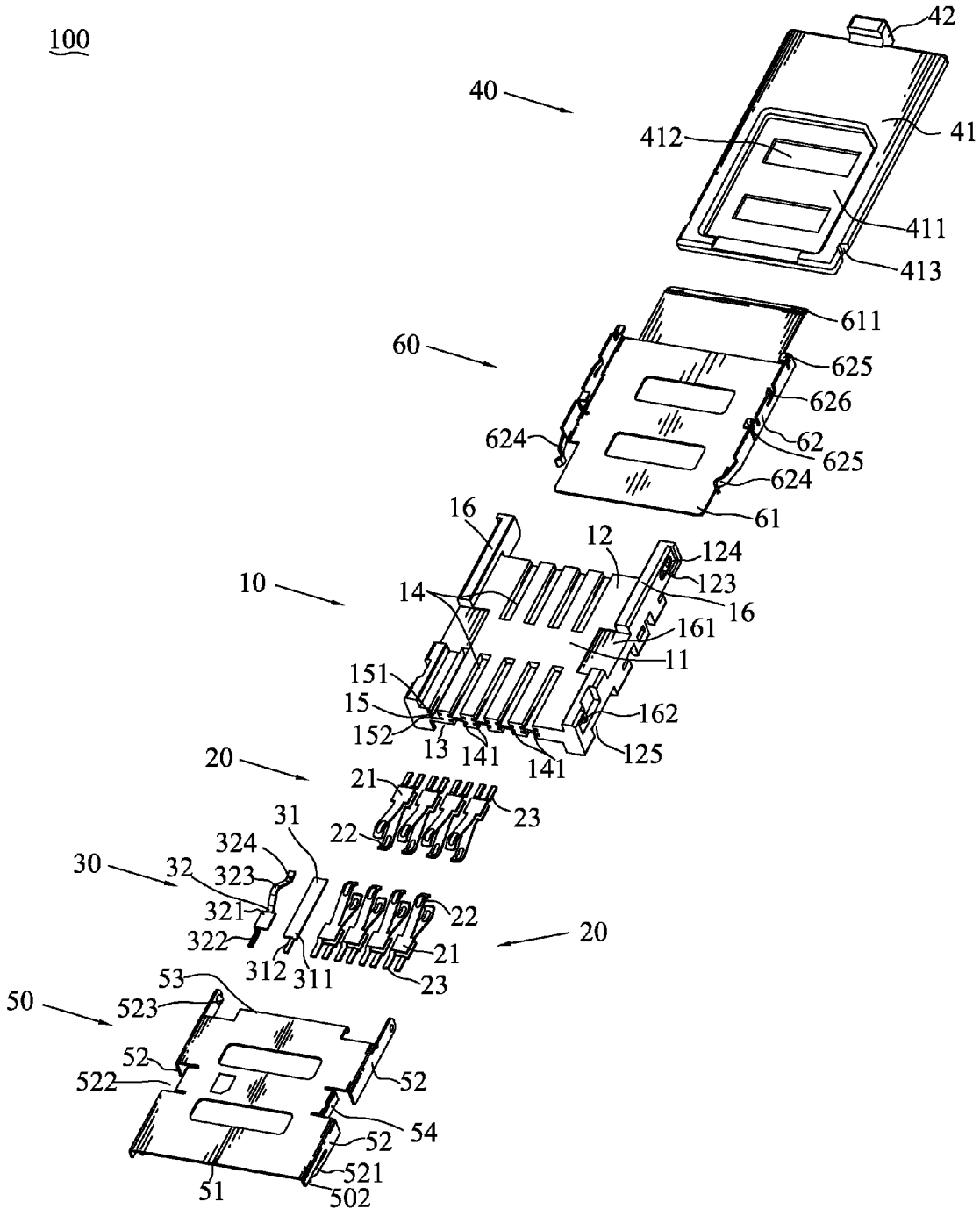
FIG. 3 is an exploded view of the dual-card connector of FIG. 1.

With reference to FIGS. 1-3, a dual-card connector 100 in accordance with the present invention is shown. The dual-card connector 100 adapted for receiving dual SIM (Subscriber Identification Module) cards (not shown) therein includes an insulating housing 10, a plurality of conductive terminals 20, a switch terminal assembly 30, a tray 40, an upper cover 50 and a lower cover 60.

Figure 4:
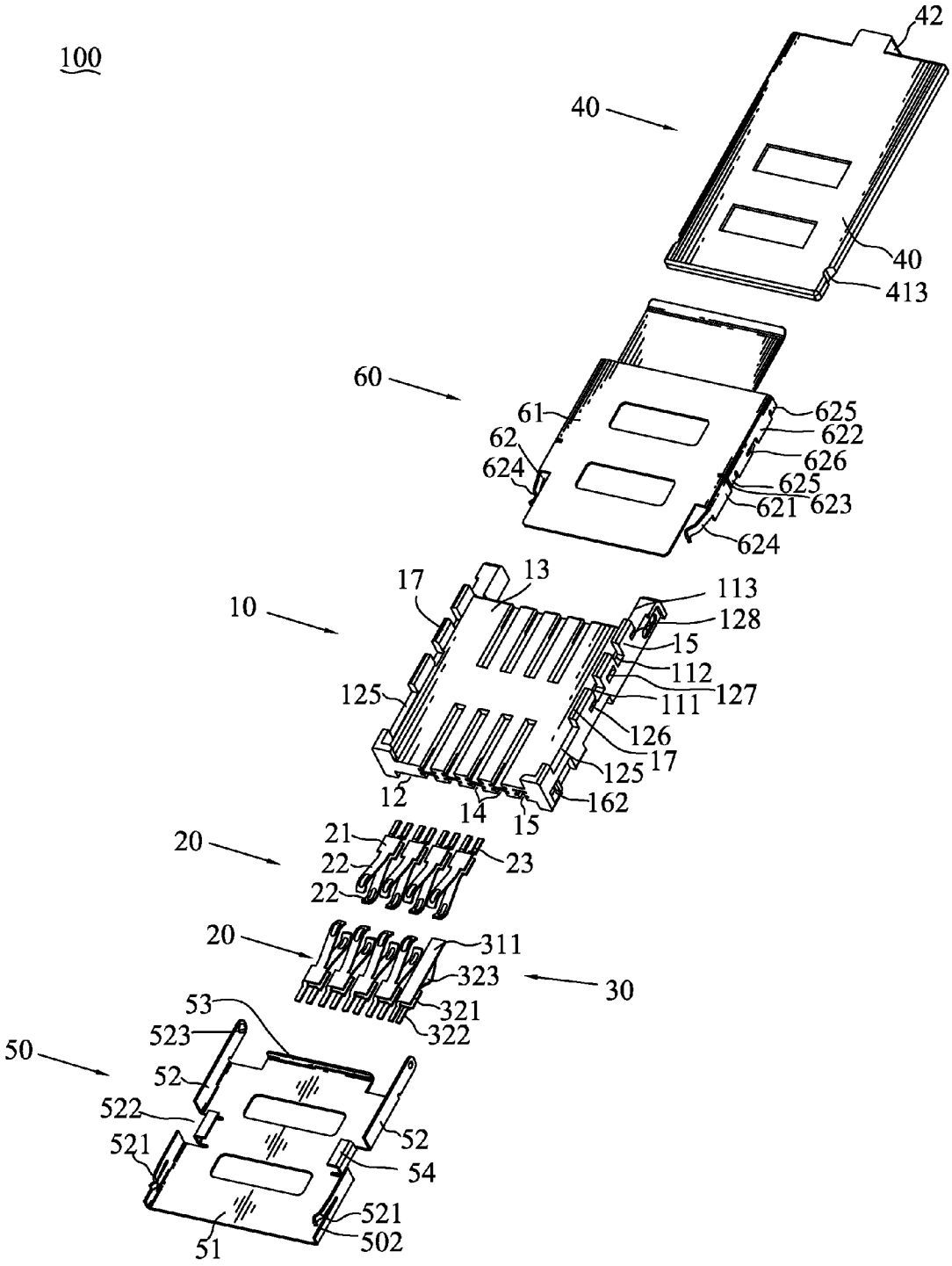
FIG. 4 is another exploded view of the dual-card connector of FIG. 1.

Referring to FIGS. 3-4, the insulating housing 10 has a base body 11 of a rectangular shape. Two upper side walls 16 and two lower side walls 17 are respectively protruded upward and downward from two opposite sides of the base body 11, a first receiving space 12 and a second receiving space 13 are correspondingly formed. A front portion and a rear portion of a top of the base body 11 respectively define a plurality of terminal grooves 14 arranged at regular intervals along a transverse direction of the base body 11 and further penetrating through outer ends of the front portion and the rear portion of the top of the base body 11. Similarly, a front portion and a rear portion of a bottom of the base body 11 respectively define a plurality of terminal grooves 14 further penetrating through outer ends of the front portion and the rear portion of the bottom of the base body 11. Two sides of the outer end of each of the terminal grooves 14 extend outward to form two fastening slots 141. The front portion of the base body 11 defines a switch terminal groove 15 located near one upper side wall 16. The switch terminal groove 15 extends longitudinally to pass through the front portion of the top of the base body 11. Two inner sidewalls of the switch terminal groove 15 define two opposite first fixed grooves 151 in bottoms thereof and two opposite second fixed grooves 152 located over fronts of the corresponding first fixed grooves 151.

Referring to FIGS. 3-4 again, a middle of each upper side wall 16 is cut off to form a restraining groove 161 of which a bottom further extended inward to the top of the base body 11. A front of an outer surface of each upper side wall 16 defines a recess 162. A rear of the outer surface of each upper side wall 16 defines an elliptical locating groove 123. Two portions of an inner side wall of the locating groove 123 define two spaced locating holes 124 arranged longitudinally. A front of a bottom of each lower side wall 17 is cut off to form a passage 125. Three portions of a bottom of a rear of the outer surface of each lower side wall 17 are cut off to define a first buffering groove 111, a second buffering groove 112 and a third buffering groove 113 spaced at intervals and arranged along a front to rear direction. A bottom of the first buffering groove 111 extends forward to form a first clipping groove 126 and a bottom of the third buffering groove 113 extends forward to form a second clipping groove 128. A buckling groove 127 is located between the first buffering groove 111 and the second buffering groove 112.

Referring to FIG. 3, each of the conductive terminals 20 has a fastening portion 21, an arch-shaped contact portion 22 and a substantial Z-shaped soldering portion 23 bent oppositely from two opposite ends of the fastening portion 21.

Referring to FIG. 3, the switch terminal assembly 30 includes a first switch terminal 31 and a second switch terminal 32. The first switch terminal 31 has a first fixed portion 311 and a first soldering arm 312 extended downward and then extended forward from a front end of the first fixed portion 311. The second switch terminal 32 includes a second fixed portion 321, a second soldering arm 322 extended downward and then forward from a front end of the second fixed portion 321, a touching portion 323 extended rearward and arched upward from a rear end of the second fixed portion 321, and a resisting portion 324 arced downward from a free end of the touching portion 323.

Referring to FIG. 3, the tray 40 of a rectangular shape includes a base board 41 with an accommodating cavity 411 formed in a top thereof, and a rib 42 protruded upward from a middle of a rear end of the base board 41. A bottom wall of the accommodating cavity 411 defines two rectangular mouths 412 penetrating the tray 40. Two opposite sides of a front of the base board 41 are concaved inward to form two notches 413.

Referring to FIG. 3 and FIG. 4, the upper cover 50 has a rectangular upper base plate 51. Two opposite sides of the upper base plate 51 protrude downward to form two upper side plates 52. A middle of a rear end of the upper base plate 51 protrudes downward to form a blocking plate 53. A bottom of a front of the upper side plate 52 is cut off to define a gap 502. A bottom of a rear end of the gap 502 extends forward and then is arced inward to form a clipping portion 521. Each side of the upper cover 50 defines a L-shaped opening 522 with one end thereof vertically penetrating through a middle of the corresponding upper side plate 52, and the other end thereof perpendicularly passing through a short distance of the upper base plate 51. An inner sidewall of each opening 522 extends outward and then is bent downward, further bent inward to form a fastening plate 54. Rear ends of two inner surfaces of the two upper side plates 52 protrude face to face to define two locating pillars 523.

Referring to FIG. 3 and FIG. 4, the lower cover 60 has a rectangular lower base plate 61. Two opposite sides of middles of the lower base plate 61 protrude upward to form two lower side plates 62. A rear end of the lower base plate 61 is inclined downward to define a guiding plate 611. The lower side plate 62 is divided into a front lower side plate 621 and a rear lower side plate 622 by a slit 623. A front end of each front lower side plate 621 is extended frontward to form an elastic portion 624 with a free end thereof arched inward. Two ends of a bottom of the rear lower side plate 622 are bent inward to form two insertion portions 625. A middle of the bottom of the rear lower side plate 622 is punched inward to form a buckling portion 626.

Referring to FIGS. 1-4, in assembly, the fastening portions 21 of the conductive terminals 20 are received in the terminal grooves 14 with two sides thereof being fastened in the fastening slots 141. The contact portions 22 are respectively projected into the first receiving space 12 and the second receiving space 13. The soldering portions 23 are projected out of the terminal grooves 14 to be soldered on a printed circuit board (not shown). The first fixed portion 311 of the first switch terminal 31 is received in the switch terminal groove 15 with two sides thereof fixed in the first fixed grooves 151 and the first soldering arm 312 projected out of the insulating housing 10 to be soldered on the printed circuit board. The second switch terminal 32 is fixed in the switch terminal groove 15 and located over the first switch terminal 31 with two sides of the second fixed portion 321 fixed in the second fixed grooves 152. The touching portion 323 is projected into the first receiving space 12. The resisting portion 324 is located in the switch terminal groove 15 and over the first fixed portion 311 with a small interval therebetween. The second soldering arm 322 is projected out of the insulating housing 10 to be soldered on the printed circuit board.

The upper cover 50 is covered on a top of the first receiving space 11 of the insulating housing 10 to from a first insertion space 70 between the upper cover 50 and the insulating housing 10. The locating pillars 523 are pivotably inserted in the locating holes 124. The blocking plate 53 is located over the rear portion of the top of the base body 11. The lower cover 60 is vertically covered to a bottom of the second receiving space 12 of the insulating housing 10 to form a second insertion space 80 between the lower cover 60 and the insulating housing 10. The elastic portions 624 are located in the passage 125 to be projected into the second receiving space 13. The inserting portions 625 are pushed into the first and second clipping grooves 126, 128 through the first and third buffering grooves 111, 113. The buckling portions 626 are pushed into the buckling grooves 127 through the second buffering grooves 112.

In use, when the upper cover 50 is in an opened position, a first SIM (Subscriber Identity Module) card (not shown) is inserted into the upper cover 50. When the upper cover 50 is in a closed position, the clipping portions 521 are received in the recesses 162 and the fastening plates 54 are restrained in the restraining grooves 161 to limit the first SIM card in the first insertion space 70, and a rear of the first SIM card is blocked by the blocking plate 53 for preventing the first SIM card excessively inserted into the first insertion space 70. Meanwhile, the contact portions 23 of the conductive terminals 20 are contacted with the first SIM card and the touching portion 323 of the second switch terminal 32 is pressed downward to make the resisting portion 324 resisting on the first fixed portion 321. A second SIM card (not shown) can be received in the accommodating cavity 411 of the tray 40. Then push the rib 42 of the tray 40 to push the base board 41 together with the second SIM card into the second insertion space 80 along the guiding plate 611 with the contact portions 22 of the conductive terminals 20 projected into the accommodating cavity 411 through the two mouths 412 and the free ends of the elastic portions 624 received in the notches 413. In this embodiment, the second SIM card is a micro SIM card.

As described above, the first insertion space 70 for receiving the first SIM card and the second insertion space 80 for receiving the second SIM card accommodated in the accommodating cavity 411 of the tray 40 are just disposed reversely to make the dual-card connector 100 occupied a smaller space in a mobile phone so as to improve an elaboration extent of the mobile phone and carried conveniently.

What is claimed is:

1. A dual-card connector adapted for receiving dual SIM (Subscriber Identification Module) cards therein, comprising:

an insulating housing having a base body, a top and a bottom of the base body defining two sets of longitudinal terminal grooves, each set of the terminal grooves being divided into a front row and a rear row penetrating a front end and a rear end of the base body, respectively;

a plurality of conductive terminals received in the corresponding terminal grooves of the insulating housing for electrically connecting with the dual SIM cards including a first SIM card and a second SIM card;

an upper cover covered to the insulating housing, a first insertion space formed between the upper cover and the insulating housing for receiving the first SIM card;

a lower cover covered to the insulating housing, a second insertion space formed between the lower cover and the insulating housing for receiving the second SIM card; and a tray having an accommodating cavity formed in a top thereof for accommodating the second SIM card therein, the tray being inserted into the second insertion space.

2. The dual-card connector as claimed in claim 1, wherein the upper cover is pivotably mounted to the insulating housing, the first SIM card is inserted into the upper cover when the upper cover is in an opened position, and contacts with the corresponding conductive terminals when the upper cover is in a closed position, the second SIM card is inserted into the second insertion space from a rear end of the second insertion space.

3. The dual-card connector as claimed in claim 2, wherein a rear end of the upper cover extends downward to form a blocking plate for blocking the first SIM card.

4. The dual-card connector as claimed in claim 1, wherein two sides of the tray defines a pair of notches, respectively, the insulating housing has two lower side walls, each lower side wall defines a gap, the lower cover has two lower side plates with two elastic portions extended frontward therefrom and positioned in the gap, each elastic portion has a free end arched inward into the second insertion space for being buckled in the corresponding notch.

5. The dual-card connector as claimed in claim 1, wherein a rear end of a lower base plate of the lower cover is inclined downward to define a guiding plate for guiding the tray into the second insertion space.

6. A dual-card connector adapted for receiving dual SIM (Subscriber Identification Module) cards therein, comprising:

an insulating housing having a base body, a top and a bottom of the base body defining two sets of longitudinal terminal grooves, each set of the terminal grooves being divided into a front row and a rear row penetrating a front end and a rear end of the base body, respectively;

a plurality of conductive terminals received in the corresponding terminal grooves of the insulating housing for electrically connecting with the dual SIM cards including a first SIM card and a second SIM card;

an upper cover covered to the insulating housing, a first insertion space formed between the upper cover and the insulating housing for receiving the first SIM card;

a lower cover covered to the insulating housing, a second insertion space formed between the lower cover and the insulating housing for receiving the second SIM card; and a first switch terminal and a second switch terminal disposed in the top of the base body, the first switch terminal located over the second switch terminal, the first switch terminal having a first fixed portion and a first soldering arm extended from the first fixed portion and out of a front end of the base body, the second switch terminal having a second fixed portion, a second soldering arm extended from the second fixed portion and out of a front end of the base body, a touching portion extended rearward and arched upward from a rear end of the second fixed portion, and a resisting portion arced downward from a free end of the touching portion, the resisting portion spaced from the first fixed portion with a small interval therebetween.

* * * * *